US008616219B2

(12) United States Patent
Richardson et al.

(10) Patent No.: US 8,616,219 B2
(45) **Date of Patent: *Dec. 31, 2013**

(54) FILTER FOR A SMOKING ARTICLE

(75) Inventors: John Richardson, London (GB); Joseph Peter Sutton, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/519,879

(22) PCT Filed: Nov. 19, 2010

(86) PCT No.: PCT/EP2010/067860

§ 371 (c)(1),
(2), (4) Date: Aug. 24, 2012

(87) PCT Pub. No.: WO2011/080007

PCT Pub. Date: Jul. 7, 2011

(65) Prior Publication Data

US 2012/0305014 A1 Dec. 6, 2012

(30) Foreign Application Priority Data

Dec. 31, 2009 (GB) ..... 0922698.6

(51) Int. Cl.

| | |
|---|---|
| ***A24D 3/04*** | (2006.01) |
| ***A24D 1/04*** | (2006.01) |
| ***A24C 5/47*** | (2006.01) |
| ***A24C 5/46*** | (2006.01) |

(52) U.S. Cl.
USPC ..... 131/346; 131/69; 131/90; 131/284; 131/344; 131/365

(58) Field of Classification Search
USPC ..... 131/346, 365
See application file for complete search history.

(56) References Cited

U.S. PATENT DOCUMENTS

| | | | |
|---|---|---|---|
| 3,370,592 | A | 2/1968 | Schultz et al. |
| 4,015,610 | A | 4/1977 | Pasche |
| 4,174,720 | A | 11/1979 | Hall |

(Continued)

FOREIGN PATENT DOCUMENTS

| | | | |
|---|---|---|---|
| DE | 10116562 | A1 | 10/2002 |
| EP | 0658319 | A1 | 6/1995 |

(Continued)

OTHER PUBLICATIONS

International Search Report and Written Opinion, mailed Feb. 25, 2011, for PCT International Application No. PCT/EP2010/067860, filed Nov. 19, 2010.

(Continued)

*Primary Examiner* — Richard Crispino
*Assistant Examiner* — Eric Yaary
(74) *Attorney, Agent, or Firm* — N. W. Poulsen

(57) ABSTRACT

A filter (3) for a smoking article (1) comprises one or more segments (4*a*, 4*b*, 4*c*) of filtration media and a substantially transparent wrapper (5). The one or more filter segments (4*a*, 4*b*, 4*c*) and the wrapper (5) define a recess or cavity in the filter (3). An anchoring adhesive (7) is provided to secure the one or more filter segments (4*a*, 4*b*, 4*c*) to the wrapper (5). The anchoring adhesive (7) is disposed exclusively between the wrapper (5) and portions of the one or more filter segments (4*a*, 4*b*, 4*c*) other than those corresponding to the recess or cavity.

15 Claims, 8 Drawing Sheets

(56) References Cited

U.S. PATENT DOCUMENTS

| | | | |
|---|---|---|---|
| 4,185,645 | A | 1/1980 | Boegli et al. |
| 4,223,597 | A | 9/1980 | Lebet |
| 5,396,909 | A | 3/1995 | Gentry et al. |
| 2002/0153017 | A1 | 10/2002 | Georgitsis et al. |

FOREIGN PATENT DOCUMENTS

| | | | |
|---|---|---|---|
| EP | 1252832 | A2 | 10/2002 |
| EP | 1972213 | A1 | 9/2008 |
| GB | 740329 | A | 11/1955 |
| GB | 1094642 | A | 12/1967 |
| GB | 1479048 | A | 7/1977 |
| LU | 52346 | A1 | 1/1967 |
| WO | 2004/068975 | A1 | 8/2004 |
| WO | 2008/038151 | A2 | 4/2008 |
| WO | 2009/106374 | A1 | 9/2009 |

OTHER PUBLICATIONS

Written Opinion, mailed Feb. 1, 2012, for PCT International Application No. PCT/EP2010/067860, filed Nov. 19, 2010.

International Preliminary Report on Patentability, mailed Apr. 2, 2012, for PCT International Application No. PCT/EP2010/067860, filed Nov. 19, 2010.

Search Report dated Jan. 27, 2010, for UK application No. GB 0910198.1, filed Jun. 12, 2009.

International Search Report and Written Opinion, mailed Jul. 29, 2010, for PCT International Application No. PCT/EP2010/056091, filed May 5, 2010.

FILTER FOR A SMOKING ARTICLE

CLAIM FOR PRIORITY

This application is a National Stage Entry entitled to and hereby claims priority under 35 U.S.C. §§365 and 371 to corresponding PCT Application No. PCT/EP2010/067860, filed Nov. 19, 2010, which in turn claims priority to British Application Serial No. GB 0922698.6, filed Dec. 31, 2009. The entire contents of the aforementioned applications are herein expressly incorporated by reference.

The present invention relates to a filter for a smoking article and, more particularly, to a filter with a window portion therein and a method of producing the same.

Conventionally, smoking articles such as cigarettes comprise a tobacco rod in the form of a cylinder of tobacco or tobacco-based smokable material wrapped in a paper wrapper, which may be provided with a filter at one end thereof. In its basic form, the filter is a cylindrical plug formed from filtration material such as cellulose acetate tow which may be wrapped in a layer of plug wrap which helps maintain the cylindrical shape and structure of the filter. The filter is joined to the tobacco rod using a tipping paper, which is an outer paper layer wrapped around the filter and overlapping the join between the filter and tobacco rod. The tipping paper is glued in place. Known filters may optionally include features to modify the smoke flow and filter function, such as recesses and gaps, and additives such as particulate carbon.

Further known filters for smoking articles include transparent plug wraps, as well as tipping wrappers which do not cover the entire filter, such that a portion of the plug wrap of the filter remains exposed and, since the plug wrap is transparent, a window portion is formed through which the filter material is visible.

In addition to such 'window'-type filters, 'multi-segment' type filters are known which comprise a plurality of separate filter plug segments, normally each wrapped in a plug wrap (an 'inner' plug wrap), and the segments being held within a further 'outer' plug wrap, wherein the filter segments may be immediately adjacent to and in contact with one another, or may be spaced from each other with a gap therebetween and therefore form a cavity within the filter. In the latter version, the cavity in the filter between the filter plug segments may be empty (i.e. an air space) or may be filled with a filler material such a granulated smoke modifying material, such as granulated carbon or a granulated flavouant material. It may be that such window-type filters may also be multi-segment type filters such that the cavity, the material within the cavity, or one or more of the filter plug segments may be visible through the window formed by the transparent outer plug wrap.

Conventional methods of construction of known filters, especially multi-segment filters as described above, involves a line of adhesive being applied to the inner surface of the outer plug wrap immediately prior to the or each filter plug/segment being placed onto the outer plug wrap and the outer plug wrap then being brought around the filter plug/segments and sealed at a lap seam with adhesive. The initial line of adhesive on the inside of the outer plug wrap is a continuous line of adhesive and is known as an 'anchorage line' and prevents the filter plug/segments from moving relative to the plug wrap or from sliding out of the plug wrap during subsequent manufacturing steps of the smoking article.

In conventional smoking articles in which the plug wrap is made of an opaque material such as paper, the application of the continuous anchorage line on the inside of the plug wrap is not a problem as it is not visible from the outside of filter. However, in the manufacture of window-type filters in which the outer plug wrap is transparent, the anchorage line is visible on the inside of the outer plug wrap in the window portion of the filter. This is especially problematic with multi-segment filters where a cavity is formed between two of the filter segments (which may either be left empty or filled with another material), because the anchorage line of adhesive in the space is particularly visible as a line of adhesive residue and spoils the appearance of the window-filter of the smoking article.

It is therefore an object of the present invention to provide a method of manufacturing a filter for a smoking article that substantially alleviates or overcomes the problems mentioned above, a filter substantially devoid of the above problems and a smoking article incorporating such a filter.

Accordingly, the present invention provides a filter for a smoking article comprising one or more segments of filtration media and a substantially transparent wrapper, the one or more filter segments and the wrapper defining a cavity, wherein an anchoring adhesive is provided to secure the one or more filter segments to the wrapper, said anchoring adhesive being disposed exclusively between the wrapper and portions of the one or more filter segments other than those corresponding to the recess or cavity.

The anchoring adhesive may be an activatable adhesive, and may be a heat-activated adhesive.

The filter may comprise two or more filter segments spaced from each other to define at least one cavity within the filter. The anchoring adhesive may be disposed exclusively between the wrapper and the filter segments. The cavity may be an empty air-filled space or may contain a further smoke-modifying material such as a granular absorbent material.

The wrapper may be clear transparent or may be colour tinted, and may include indicia or graphics printed thereon.

The present invention also provides a smoking article comprising a rod of smokable material such as tobacco or tobacco substitute, a filter attached to one end of the rod of smokable material and a window formed in the filter, the filter comprising one or more segments of filtration media and a substantially transparent wrapper, at least part of which forms at least part of the window, wherein an anchoring adhesive is provided to secure the one or more filter segments to the wrapper, said anchoring adhesive being disposed exclusively between the one or more filter segments and portions of the wrapper other than those forming at least part of the window.

The filter may comprise a filter as described above, and the smoking article may further comprise a tipping wrapper attaching the filter to the rod of smokable material, and the tipping wrapper may extend over only part of the length of the filter such that a portion of the filter remains exposed to define the window to enable the cavity or recess within the interior of the filter to be visible through the transparent wrapper.

The tipping wrapper may comprise a first tipping wrapper and the smoking article may further comprise a second tipping wrapper circumscribed around the mouth-end of the filter and axially spaced from the first tipping wrapper so that said window is defined between the first and second tipping wrappers. The window between the first and second tipping wrappers may be aligned with the cavity or recess in the filter.

The present invention also provides a method of manufacturing a filter for a smoking article comprising locating one or more segments of filtration media in axial alignment on a substantially transparent wrapper, providing an anchoring adhesive to secure the one or more filter segments to the wrapper, and circumscribing the wrapper around the one or more filter segments to define a recess or cavity, wherein the step of providing the anchoring adhesive comprises providing anchoring adhesive exclusively between the wrapper and portions of the one or more filter segments other than those corresponding to the recess or cavity.

The step of locating one or more segments of filtration media comprises locating a plurality of segments of filtration media in axial alignment on the substantially transparent wrapper and spaced from one another to define a gap therebetween and wherein circumscribing the wrapper comprises circumscribing the wrapper around the filter segments to define a cavity between the filter segments.

The anchoring adhesive may be applied to the wrapper at specific locations where the filter segments are to be located on the wrapper.

The method may further comprise conveying the wrapper as a continuous strip past an anchoring adhesive applicator and intermittently applying the anchoring adhesive onto the wrapper strip in discrete locations as it passes the anchoring adhesive applicator.

The method may yet further comprise placing filter segments onto the wrapper strip at a location downstream of the anchoring adhesive applicator in register with the conveyance speed of, and anchoring adhesive location on, the wrapper strip such that the filter segments are placed entirely over the discrete sections of anchoring adhesive.

The filter segments may be placed on the wrapper and the anchoring adhesive may be applied directly to each filter segment.

The method may comprise conveying the wrapper as a continuous strip, placing filter segments onto the wrapper strip at discrete locations and, applying the anchoring adhesive from an applicator in register with the conveyance speed of, and specific filter segment location on, the wrapper strip such that the anchoring adhesive is only applied to the filter segments.

The anchoring adhesive may be applied to each filter segment prior to placement of each filter segment on the wrapper.

The anchoring adhesive may be an activatable adhesive, and the method may further comprise conveying the wrapper as a continuous strip, placing filter segments with the activatable anchoring adhesive thereon onto the wrapper strip at discrete locations and, using an adhesive activating means to activate the adhesive on the filter segments.

The anchoring adhesive may be a heat-activated adhesive and the adhesive activating means may be a heating means.

The method may further comprise wrapping the wrapper strip around the line of filter segments thereon to form a continuous rod of filters and then cutting the continuous rod at regular intervals.

The present invention also provides a method of manufacturing filter segments for use in a filter for a smoking article comprising forming a continuous rod of filter material, conveying a continuous strip of inner plug wrap past an adhesive applicator nozzle and applying adhesive to one side of the inner plug wrap, wrapping the continuous rod of filter material with the inner plug wrap with the adhesive on the outside to form a continuous rod of wrapped filter material, and cutting the continuous rod of wrapped filter material into individual filter segments.

The method may further comprise applying adhesive on both sides of the inner plug wrap.

The present invention also provides a method of manufacturing a filter for a smoking article comprising manufacturing filter segments as described above and then manufacturing a filter as described above using said filter segments.

In order that the invention may be more fully understood, embodiments of the invention will now be described, by way of illustrative example only, with reference to the accompanying drawings in which.

Figure 1:
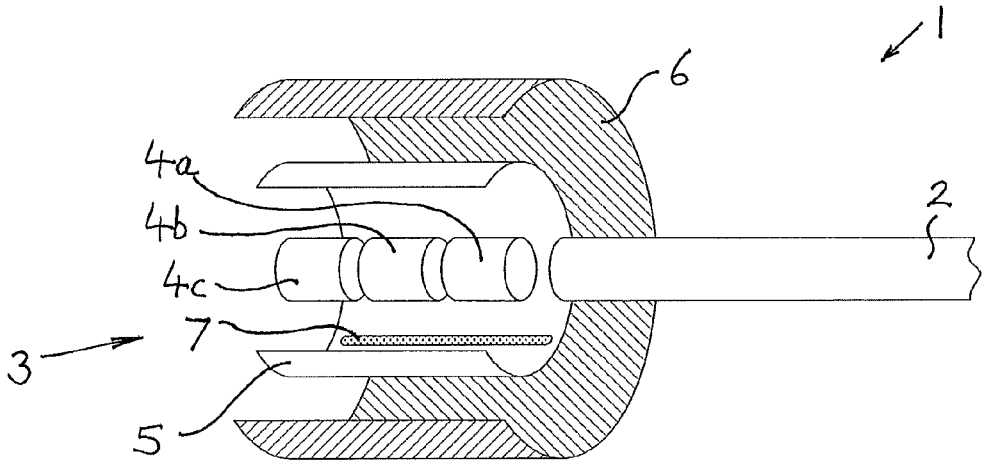
FIG. 1 is an exploded perspective view of a smoking article having a conventional multi-segment filter.

Referring now to FIG. 1, a conventional smoking article 1 having a multi-segment type filter is shown which comprises a tobacco rod 2 and a filter 3. The tobacco rod 2 is of conventional form and comprises a cylinder of tobacco or tobacco-based smokable material wrapped in a paper wrapper. The filter 3 comprises three axially-aligned cylindrical filter segments/plugs 4*a*, 4*b*, 4*c* of filtration media, such as cellulose acetate, circumscribed by an outer plug wrap 5. (Although not specifically illustrated, each cylindrical filter segment 4*a*-4*c* may also be wrapped in its own individual inner plug wrap to maintain the filter segment in a cylindrical shape). The filter 3 is joined to the tobacco rod 2 by a tipping wrapper 6 which is wrapped around the filter 3 and overlies the join between the filter 3 and the tobacco rod 2.

The outer plug wrap 5 includes an 'anchorage line' 7 which is a line of adhesive on the inside of the outer plug wrap 5 on which the filter segments 4*a*, 4*b*, 4*c* are placed and which secures the filter segments 4*a*, 4*b*, 4*c* to the outer plug wrap 5 during subsequent construction stages of the filter and smoking article manufacturing processes—for example, to stop the filter segments 4*a*, 4*b*, 4*c* moving on the outer plug wrap 5 as it is wrapped around the filter segments 4*a*, 4*b*, 4*c* and to stop the filter segments 4*a*, 4*b*, 4*c* from sliding out of the tube of outer plug wrap 5 when the formed filter 3 is joined to the tobacco rod 2 by the tipping wrapper 6.

In the conventional smoking article shown in FIG. 1, the outer plug wrap 5 and the tipping wrapper 6 are both made of an opaque material, such as paper, and so the anchorage line 7 is not visible on the outside of the finished smoking article.

Figure 2:
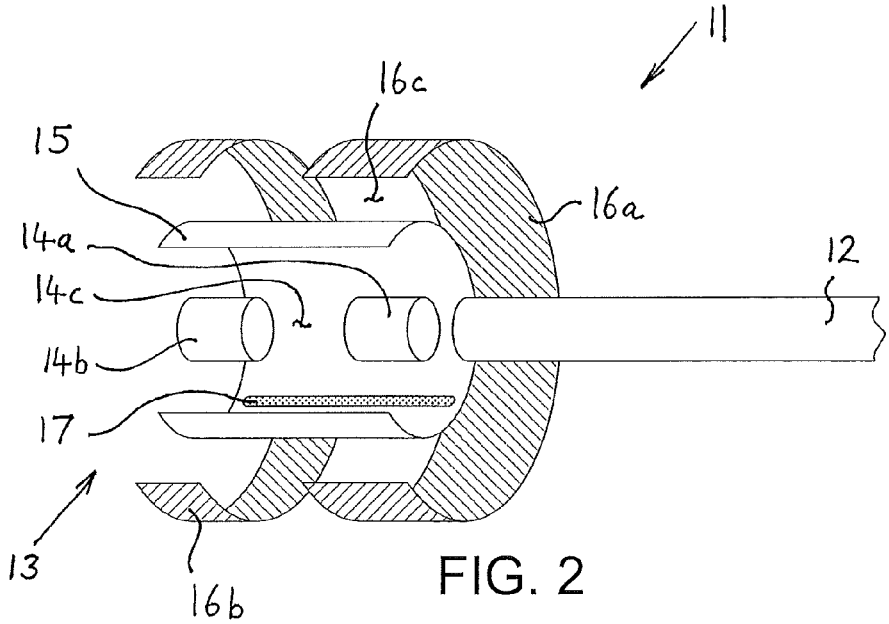
FIG. 2 is an exploded perspective view of a smoking article having an alternative type of conventional multi-segment filter.
Figure 4:
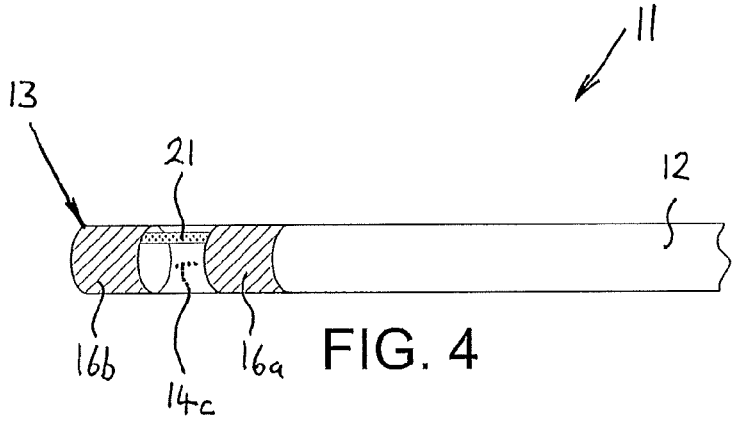
FIG. 4 is a perspective view of the smoking article of FIG. 2.

Referring now to FIGS. 2 and 4, another known type of smoking article 11 is shown which has a multi-segment filter and which comprises a tobacco rod 12 and a filter 13. The filter 13 is of a type known as a 'window' filter, and comprises two axially-aligned cylindrical segments/plugs 14*a*, 14*b* of filtration media, such as cellulose acetate, circumscribed by an outer plug wrap 15. (Although not specifically illustrated, each cylindrical filter segment 14*a*, 14*b* may also be wrapped in its own individual inner plug wrap to maintain the filter segment in a cylindrical shape). The two filter segments 14*a*, 14*b* are spaced from each other in the filter 13 to define a cavity 14*c* therebetween within the filter 13. The filter 13 is joined to the tobacco rod 12 by a first tipping wrapper 16*a* which is wrapped around the filter 13 and overlies the join between the filter 13 and the tobacco rod 12. A second tipping wrapper 16*b* is wrapped around the distal mouth-engaging end of the filter 13 and is spaced from the first tipping wrapper 16*a* to define a gap 16*c* therebetween. The outer plug wrap 15 is made of a transparent material and so the interior of the cavity 14*c* in the filter 13 is visible through the 'window' formed by the transparent outer plug wrap 15 and the gap 16*c* between the first and second tipping wrappers 16*a*, 16*b*.

Figure 3:
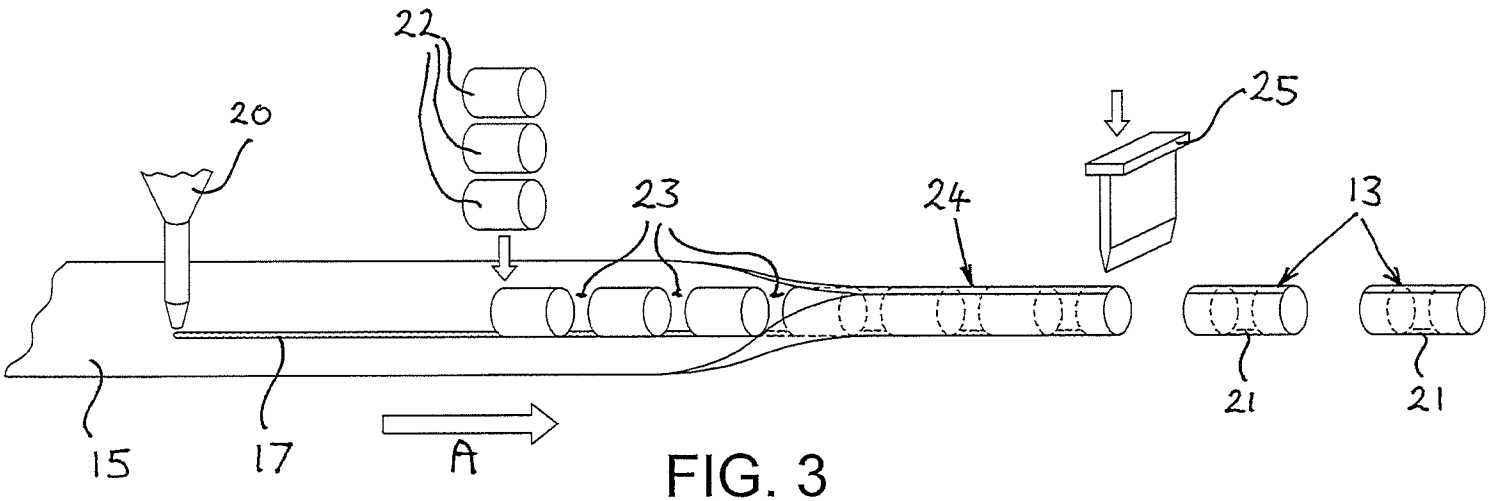
FIG. 3 is a schematic view of a conventional manufacturing process for producing filters shown in FIG. 2.

As with the outer plug wrap 5 of the first-described conventional smoking article 1, the outer plug wrap 15 includes an 'anchorage line' of adhesive 17 on the inside thereof on which the filter segments 14*a*, 14*b*, are placed to secure them to the outer plug wrap 15. The conventional process of applying the anchorage line 17 to the outer plug wrap 15 is shown schematically in FIG. 3. The outer plug wrap 15 is conveyed in the direction of arrow 'A' as a continuous strip from a reel or other such supply (not shown) past an anchorage adhesive applicator nozzle 20 which applies a continuous line of anchorage adhesive 17 onto the outer plug wrap 15. Downstream of the applicator nozzle 20, individual double-length filter segments 22 are placed onto the outer plug wrap 15 leaving a space 23 between each double-length filter segment 22. The outer plug wrap 15 is then brought around the double length filter segments 22 and secured in place by a lap seam using suitable apparatus (not shown) to form a continuous filter rod 24. Finally, a cutter 25 cuts the continuous filter rod 24 at the mid-point of each double length filter segment 22 to form individual filters 13, each with the pair of filter segments 14*a*, 14*b* spaced from each other to define a cavity 14*c* therebetween and secured within the tube of transparent outer plug wrap 15 by the anchorage line 17 of adhesive.

Although in the process described above and illustrated in FIG. 3, the cutter 25 cuts the continuous filter rod 24 at the mid-point of each double-length filter segment 22 to form individual filters 13, in an alternative manufacturing process, the cutter 25 may cut the continuous filter rod 24 at the mid-point of every fourth or every sixth double-length filter segment 22 (for example) to form intermediate filter rods of four or six filters joined together. These '4-up' or '6-up' (for example) filter rods are chosen and created in dependence on the specific machinery to be used in a subsequent smoking article manufacturing process, which may require such 4-up or 6-up size intermediate filter rods to be supplied thereto and which then process and further divide such intermediate filter rods to form individual smoking articles with single filters 13 attached thereto.

It will be appreciated that since the applicator nozzle 20 applies a continuous anchorage line of adhesive 17 to the outer plug wrap 15, the anchorage adhesive 17 is not only disposed between each filter segment 14*a*, 14*b* and the outer plug wrap 15 where it is required to hold the filter segments 14*a*, 14*b* in place, but also on the outer plug wrap 15 in the cavity 14*c* between the filter segments 14*a*, 14*b*. This means that a glue residue line 21 (see FIGS. 3 and 4) is visible through the window of the window filter 13, which spoils the appearance of the final smoking article 11 in which it is incorporated.

Figure 5:
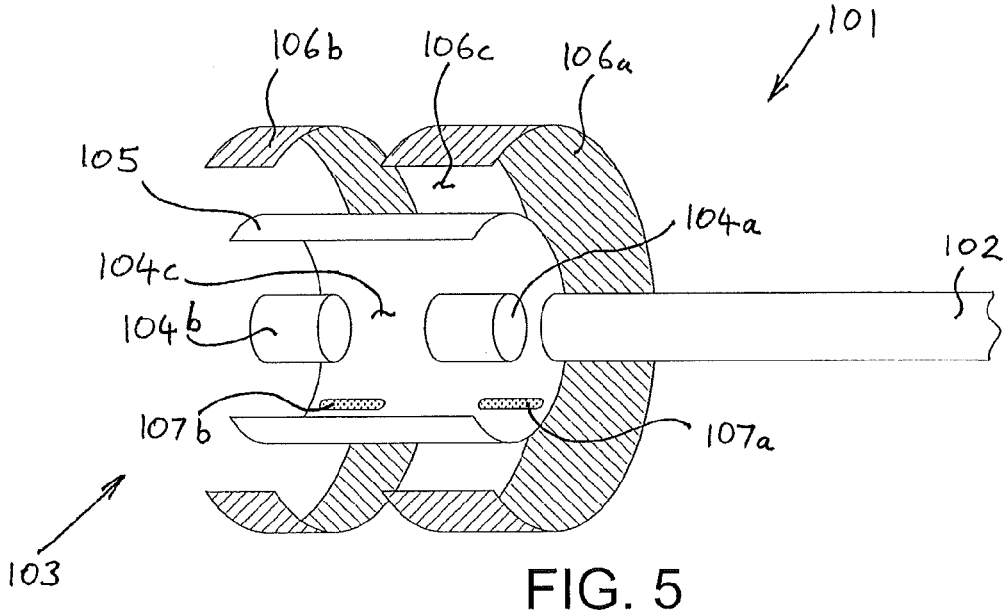
FIG. 5 is an exploded perspective view of a smoking article having a multi-segment filter of the present invention.

Referring now to FIG. 5, a smoking article 101 is shown including a multi-segment filter 103 of the present invention joined to a conventional tobacco rod 102. The filter 103 is a 'window' type filter and comprises two axially-aligned cylindrical segments/plugs 104*a*, 104*b* of filtration media, such as cellulose acetate, circumscribed by an outer plug wrap 105. (Although not specifically illustrated, each cylindrical filter segment 104*a*, 104*b* may also be wrapped in its own individual inner plug wrap to maintain the filter segment in a cylindrical shape). The two filter segments 104*a*, 104*b* are spaced from each other in the filter 103 to define a cavity 104*c* therebetween within the filter 103. As with the conventional smoking article 11 of FIG. 2, the filter 103 is joined to the tobacco rod 102 by a first tipping wrapper 106*a* which is wrapped around the filter 103 and overlies the join between the filter 103 and the tobacco rod 102 and a second tipping wrapper 106*b* is wrapped around the distal mouth-engaging end of the filter 103 and is spaced from the first tipping wrapper 106*a* to define a gap 106*c* therebetween. The outer plug wrap 105 is made of a transparent material and so the interior space of the cavity 104*c* in the filter 103 is visible through the 'window' formed by the transparent outer plug wrap 105 and the gap 106*c* between the first and second tipping wrappers 106*a*, 106*b*.

It can be seen from FIG. 5 that the outer plug wrap 105 does not include a continuous anchorage line of adhesive as with the conventional filters shown in FIGS. 1 and 2, but instead, includes a discontinuous adhesive anchorage line 107 comprising two discrete sections of adhesive 107*a*, 107*b* which are longitudinally aligned and spaced from each other, and which correspond to the positions on which the two filter segments 104*a*, 104*b*, are placed on the outer plug wrap 105. There is no adhesive in the space between the two discrete sections of adhesive 107*a*, 107*b*. It will therefore be appreciated that there is no glue residue visible in the cavity 104*c* through the window of the resulting window filter 103, and so the filter 103 of the invention does not suffer the drawbacks of the conventional window filter 13 described above.

Figure 6:
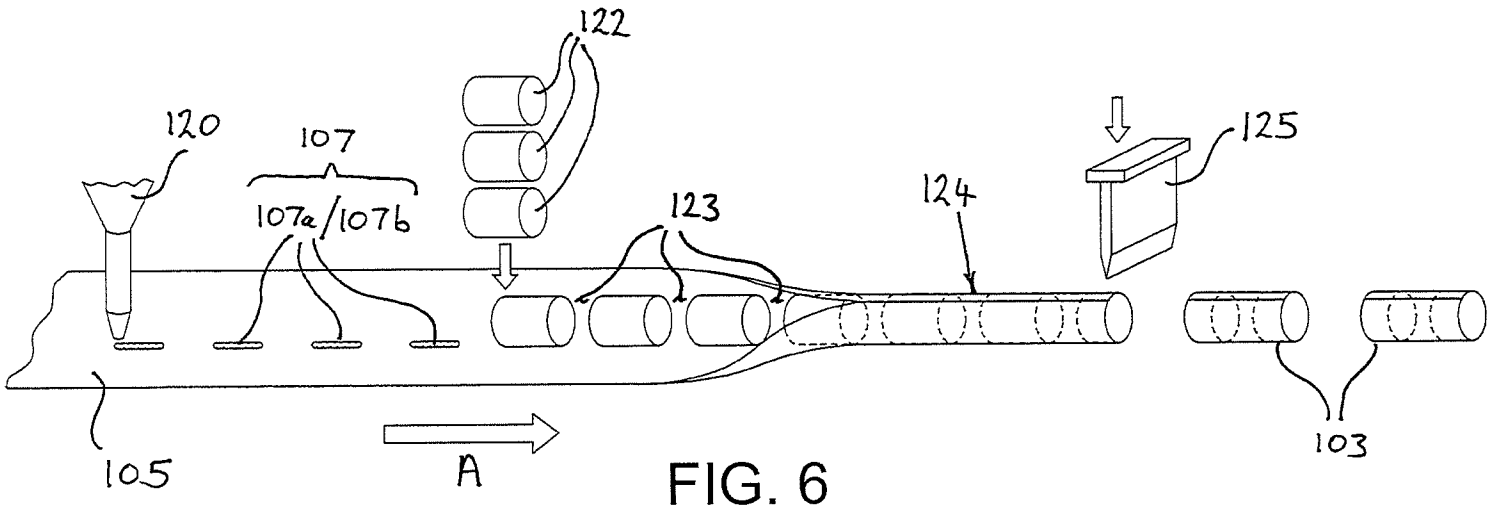
FIG. 6 is a schematic view of a manufacturing process of the invention for producing a filter as shown with the smoking article of FIG. 5.

A manufacturing process of the invention for applying the discontinuous anchorage line 107 to the outer plug wrap 105 is shown schematically in FIG. 6. As with the conventional manufacturing process described above and shown in FIG. 3, the outer plug wrap 105 is conveyed in the direction of arrow 'A' as a continuous strip from a reel or other such supply (not shown) past an anchorage adhesive applicator nozzle 120 which applies the anchorage adhesive 107 onto the outer plug wrap 105. However, the applicator nozzle 120 does not apply a continuous line of adhesive but instead, is activated to dispense adhesive intermittently as the outer plug wrap 105 is conveyed past the applicator nozzle 120, thereby resulting in a broken discontinuous adhesive anchorage line 107 of a plurality of discrete sections of adhesive 107*a*/107*b* being formed on the outer plug wrap 105. Downstream of the applicator nozzle 120, the individual double-length filter segments 122 are placed onto the outer plug wrap 105 leaving a gap 123 therebetween.

The filter segment placement is synchronised with the conveyance speed of the outer plug wrap 105 and in register with the location of the discrete sections of anchorage adhesive 107*a*/107*b* thereon such that each double-length filter segment 122 is placed directly on one respective discrete section of adhesive 107*a*/107*b* and so that the gap 123 between the double length filter segments 122 corresponds with the space between the discrete sections of adhesive 107*a*/107*b* where no adhesive is deposited on the outer plug wrap 105. Furthermore, the applicator nozzle 120 is actuated to deposit the discrete sections of anchorage adhesive 107*a*/107*b* on the outer plug wrap 105 in lengths equal to or slightly less than the length of the double-length filter segments 122. This ensures that the filter segments 122 can be placed on the discrete sections of adhesive 107*a*/107*b* such that none of the adhesive extends beyond the longitudinal ends of the double-length filter segments 122 in the gap 123 between the filter segments 122.

Downstream of the point where the double length filter segments 122 are placed onto the outer plug wrap 105, the outer plug wrap 105 is brought around the double length filter segments 122 and secured in place along a lap seam in an appropriate manner (not shown) to form a continuous filter rod 124. Finally, a cutter 125 cuts the continuous filter rod 124 at the mid-point of each double length filter segment 122 to form individual filters 103, each with the pair of filter segments 104*a*, 104*b* spaced from each other by a cavity 104*c* and secured within the tube of transparent outer plug wrap 105 by the respective discrete sections of anchorage adhesive 107*a*/107*b*.

Although in the process of the invention described above and illustrated in FIG. 6, the cutter 125 cuts the continuous filter rod 124 at the mid-point of each double-length filter segment 122 to form individual filters 103, in an alternative manufacturing process of the invention, the cutter 125 may cut the continuous filter rod 124 at the mid-point of every fourth or every sixth double-length filter segment 122 (for example) to form intermediate filter rods of four or six filters joined together. These '4-up' or '6-up' (for example) filter rods are chosen and created in dependence on the specific machinery to be used in a subsequent smoking article manufacturing process, which may require such 4-up or 6-up size intermediate filter rods to be supplied thereto and which then process and further divide such intermediate filter rods to form individual smoking articles with single filters 103 attached thereto.

It will be appreciated that the above-described filter manufacturing process of the invention ensures that there is no anchorage adhesive 107 on the outer plug wrap 105 in the cavity 104*c* between the two filter segments 104*a*, 104*b* and so there is no glue residue visible through the window of the resulting window filter 103. Therefore, the filter 103 of the invention does not suffer the drawbacks of the conventional window filter 13 described above.

Figure 7:
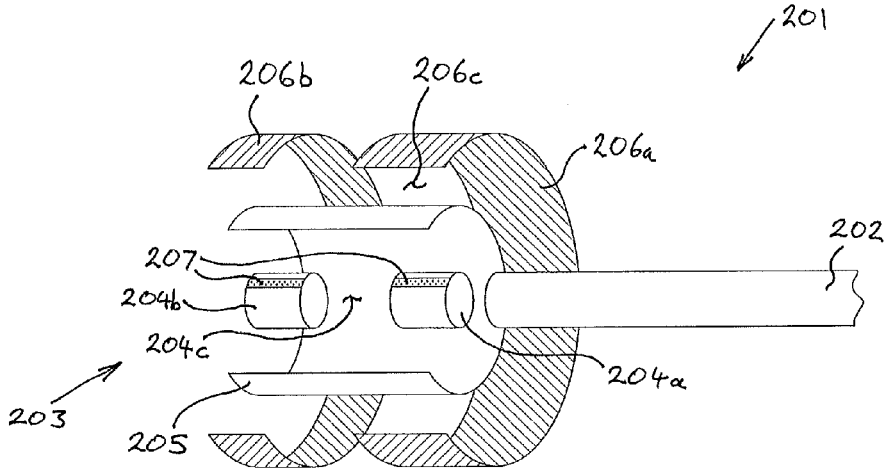
FIG. 7 is an exploded perspective view of a smoking article having an alternative multi-segment filter of the present invention.

Referring now to FIG. 7, a smoking article 201 incorporating an alternative multi-segment filter 203 of the invention is shown. The filter 203 is a 'window' type filter and, as with the filter 103 shown in FIG. 5, comprises two axially-aligned cylindrical segments/plugs 204*a*, 204*b* of filtration media, such as cellulose acetate, spaced from each other to define a gap 204*c* therebetween within the filter 203, and are circumscribed by an outer plug wrap 205. (Although not specifically illustrated, each cylindrical filter segment 204*a*, 204*b* may also be wrapped in its own individual inner plug wrap to maintain the filter segment in a cylindrical shape). The filter 203 is joined to a tobacco rod 202 by a first tipping wrapper 206*a* which is wrapped around the filter 203 and overlies the join between the filter 203 and the tobacco rod 202 and, a second tipping wrapper 206*b* is wrapped around the distal mouth-engaging end of the filter 203 and is spaced from the first tipping wrapper 206*a* to define a gap 206*c* therebetween. The outer plug wrap 205 is made of a transparent material and so the interior space of the cavity 204*c* in the filter 203 is visible through the 'window' formed by the transparent outer plug wrap 205 and the gap 206*c* between the first and second tipping wrappers 206*a*, 206*b*.

It can be seen from FIG. 7 that the filter 203 of the alternative embodiment of the invention differs from that shown in FIG. 5, in that the outer plug wrap 205 does not include any anchorage lines of adhesive, continuous or otherwise, formed thereon. Instead, an adhesive anchorage line 207 is provided directly on the filter plug segments 204*a*, 204*b* in a longitudinal direction thereof. It will therefore be appreciated that since there is no anchorage adhesive on the outer plug wrap 205, there is no glue residue visible through the window of the resulting window filter 203, and so the filter 203 does not suffer the drawbacks of the conventional window filter 13 described above.

Figure 8:
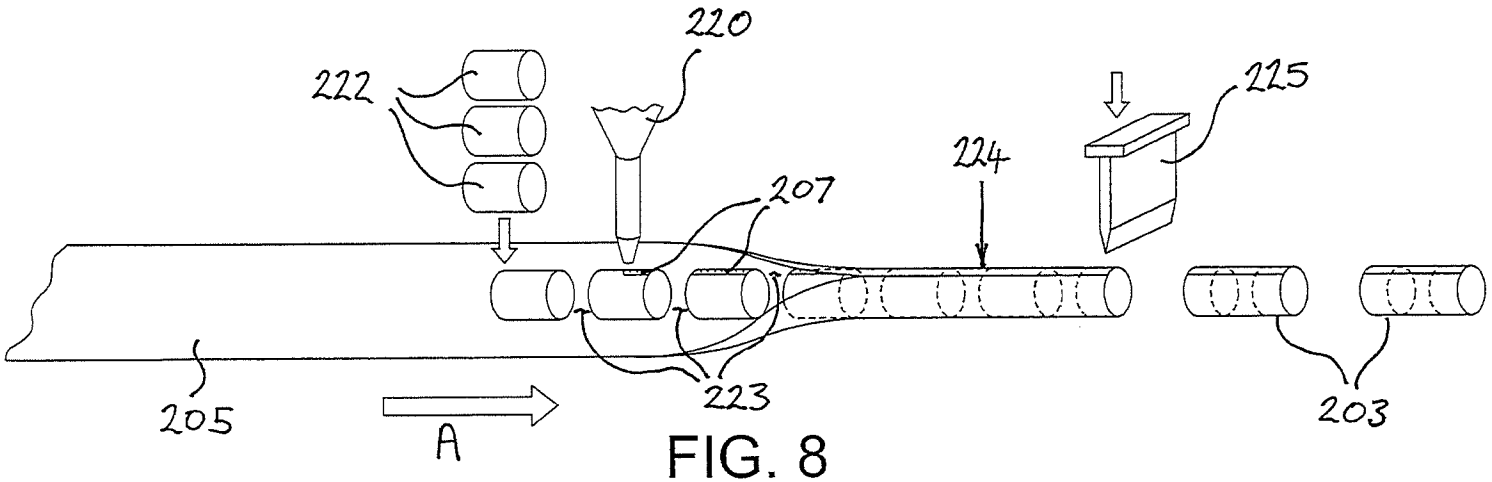
FIG. 8 is a schematic view of an alternative manufacturing process of the invention for producing a filter as shown with the smoking article of FIG. 7.

An alternative manufacturing process of the invention for applying the anchorage adhesive 207 to the filter segments 204*a*, 204*b* is shown schematically in FIG. 8. As with the conventional manufacturing process described above and shown in FIG. 3, the outer plug wrap 205 is conveyed in the direction of arrow 'A' as a continuous strip from a reel or other such supply (not shown). Individual double-length filter segments 222 are placed onto the outer plug wrap 205 leaving a gap 223 therebetween. An anchorage adhesive applicator nozzle 220 is located downstream of the point at which the double length filter plug segments 222 are placed onto the outer plug wrap 205, which applies the lines of anchorage adhesive 207 directly onto the double length filter plug segments 222. The applicator nozzle 220 is activated to dispense adhesive intermittently as the outer plug wrap 205 is conveyed past the applicator nozzle 220 so that the anchorage adhesive 207 is deposited on the double length filter plug segments 222 as they are conveyed past the applicator nozzle 220.

The applicator nozzle 220 is synchronised with the conveyance speed of the outer plug wrap 205 and in register with the location of the double length filter plug segments 222 thereon such that each line of anchorage adhesive 207 is deposited directly and only on each double length filter plug segment 222 and that no adhesive is deposited on the outer plug wrap 205 in the gaps 223 between the double length filter plug segments 222.

Downstream of the point where the applicator 220 deposits the anchorage adhesive on each double length filter segment 222, the outer plug wrap 205 is brought around the double length filter segments 222 and secured in place along a lap seam in an appropriate manner (not shown) to form a continuous filter rod 224. Finally, a cutter 225 cuts the continuous filter rod 224 at the mid-point of each double length filter segment 222 to form individual filters 203, each with the pair of filter segments 204*a*, 204*b* spaced from each other by a cavity 204*c* and secured within the tube of transparent outer plug wrap 205 by the respective discrete sections of anchorage adhesive 207.

Although in the alternative process of the invention described above and illustrated in FIG. 8, the cutter 225 cuts the continuous filter rod 224 at the mid-point of each double-length filter segment 222 to form individual filters 203, in an alternative manufacturing process of the invention, the cutter 225 may cut the continuous filter rod 224 at the mid-point of every fourth or every sixth double-length filter segment 222 (for example) to form intermediate filter rods of four or six filters joined together. These '4-up' or '6-up' (for example) filter rods are chosen and created in dependence on the specific machinery to be used in a subsequent smoking article manufacturing process, which may require such 4-up or 6-up size intermediate filter rods to be supplied thereto and which then process and further divide such intermediate filter rods to form individual smoking articles with single filters 203 attached thereto.

It will be appreciated that the above-described alternative filter manufacturing process of the invention ensures that there is no anchorage adhesive 207 on the outer plug wrap 205 in the cavity 204*c* between the two filter segments 204*a*, 204*b* and so there is no glue residue visible through the window of the resulting window filter 203. Therefore, the alternative filter 203 of the invention does not suffer the drawbacks of the conventional window filter 13 described above.

Figure 9:
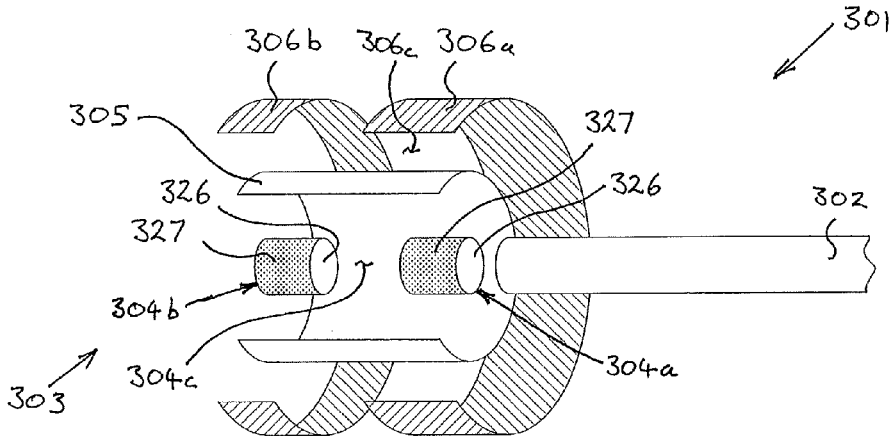
FIG. 9 is an exploded perspective view of a smoking article having a further alternative multi-segment filter of the present invention.

Referring now to FIG. 9, a smoking article 301 incorporating a further alternative multi-segment filter 303 of the invention is shown. The filter 303 is a 'window' type filter and, as with the filters 103, 203 shown in FIGS. 5 and 7 respectively, comprises two axially-aligned cylindrical segments/plugs 304*a*, 304*b* of filtration media, such as cellulose acetate, spaced from each other to define a cavity 304*c* therebetween within the filter 303, and are circumscribed by an outer plug wrap 305. The filter 303 is joined to a tobacco rod 302 by a first tipping wrapper 306*a* which is wrapped around the filter 303 and overlies the join between the filter 303 and the tobacco rod 302 and, a second tipping wrapper 306*b* is wrapped around the distal mouth-engaging end of the filter 303 and is spaced from the first tipping wrapper 306*a* to define a gap 306*c* therebetween. The outer plug wrap 305 is made of a transparent material and so the interior space of the gap 304*c* in the filter 303 is visible through the 'window' formed by the transparent outer plug wrap 305 and the gap 306*c* between the first and second tipping wrappers 306*a*, 306*b*.

It can be seen from FIG. 9 that the filter 303 of the further alternative embodiment of the invention differs from those shown in FIGS. 5 and 7 in that neither the outer plug wrap 305 nor the filter segments 304*a*, 304*b* include any longitudinal lines of anchorage adhesive, continuous or otherwise, formed thereon. Instead, an anchorage adhesive 307 is provided on the whole of the outside surface of the filter plug segments 304*a*, 304*b*. It will therefore be appreciated that since there is no anchorage adhesive on the outer plug wrap 305, there is no glue residue visible through the window of the resulting window filter 303, and so the filter 303 does not suffer the drawbacks of the conventional window filter 13 described above.

Figure 10:
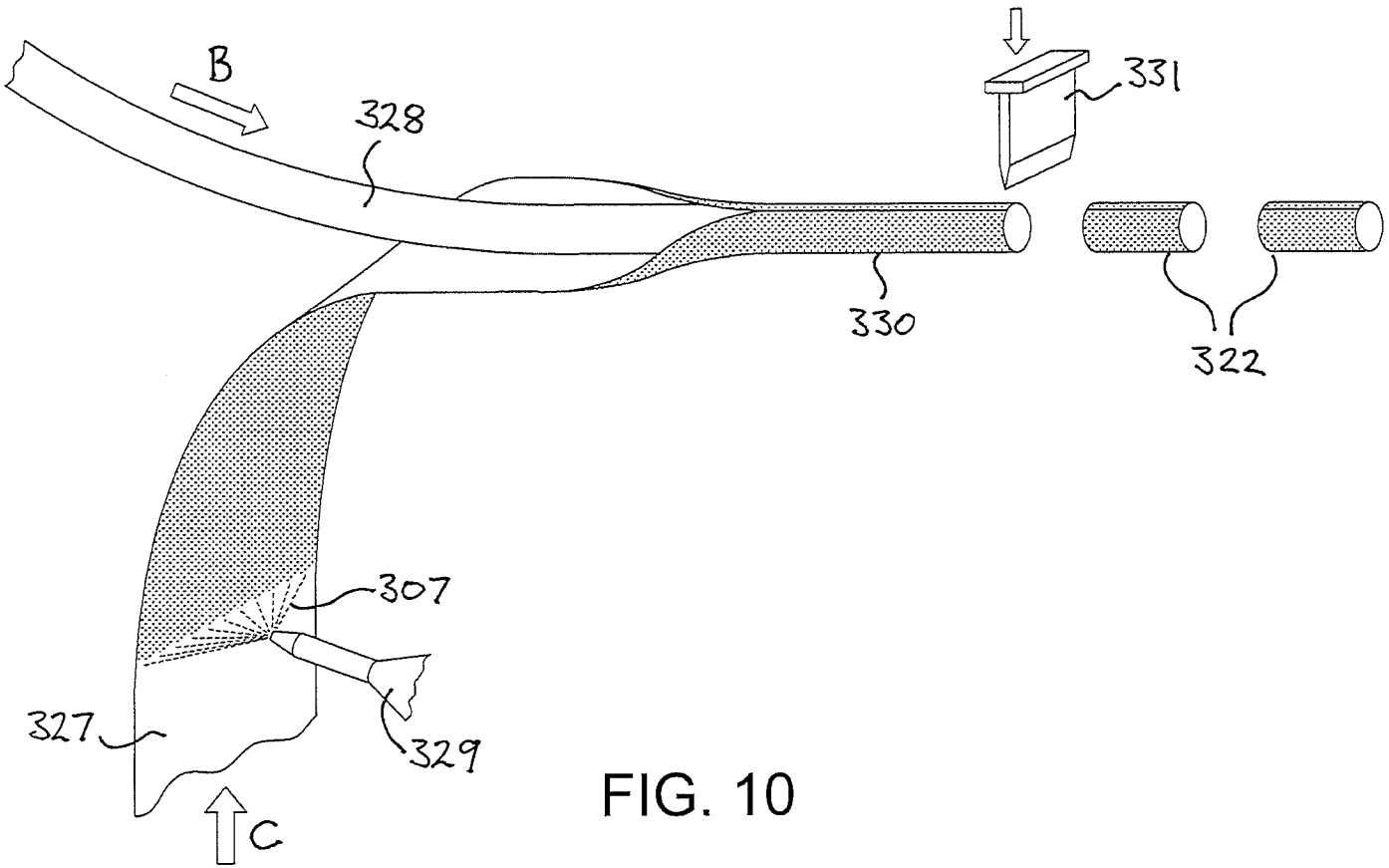
FIG. 10 is a schematic view of a manufacturing process of the invention for producing filter plug segments as shown with the smoking article of FIG. 9.

Each of the filter segments 304*a*, 304*b* comprises a cylindrical plug of filter material 326, such as cellulose acetate tow, circumscribed by an inner plug wrap 327 which serves to contain the loose filter material in a cylindrical form and holds the cylindrical plug of filter material 326 in shape. A manufacturing method of the invention for producing the filter segments 304*a*, 304*b* with the anchorage adhesive on their outer surface, is shown schematically in FIG. 10. A continuous rod of filter material 328 is conveyed in the direction of arrow 'B' from a filter material source and rod-forming apparatus (not shown). The inner plug wrap 327 material is conveyed in the direction of arrow 'C' as a continuous strip from a reel or other such supply (not shown) towards the continuous rod of filter material 328. Upstream of the inner plug wrap material 327 meeting the continuous rod of filter material 328, the inner plug wrap 327 material passes by an anchorage adhesive spray nozzle 329 which coats one side (to be the outside of the finished filter segments 304*a*, 304*b*) with anchorage adhesive 307. This anchorage adhesive 307 is an activatable adhesive which dries on the inner plug wrap 327 without remaining sticky, and can then be activated later, e.g. by subjecting to heat, to activate the adhesive properties when required.

Downstream of the spray nozzle 329, the inner plug wrap 327 meets the continuous rod of filter material 328 with the non-adhesive side of the inner plug wrap 327 in contact with the continuous rod of filter material 328, and the inner plug wrap 327 is then wrapped around the continuous rod of filter material 328 and sealed in place along a lap seam in an appropriate manner (not shown) such that a continuous wrapped filter rod 330 is produced. Finally, a cutter 331 cuts the continuous rod 330 into individual double-length filter segments 322, each having the dried activatable anchorage adhesive 307 coated on their outer surface.

Figure 11:
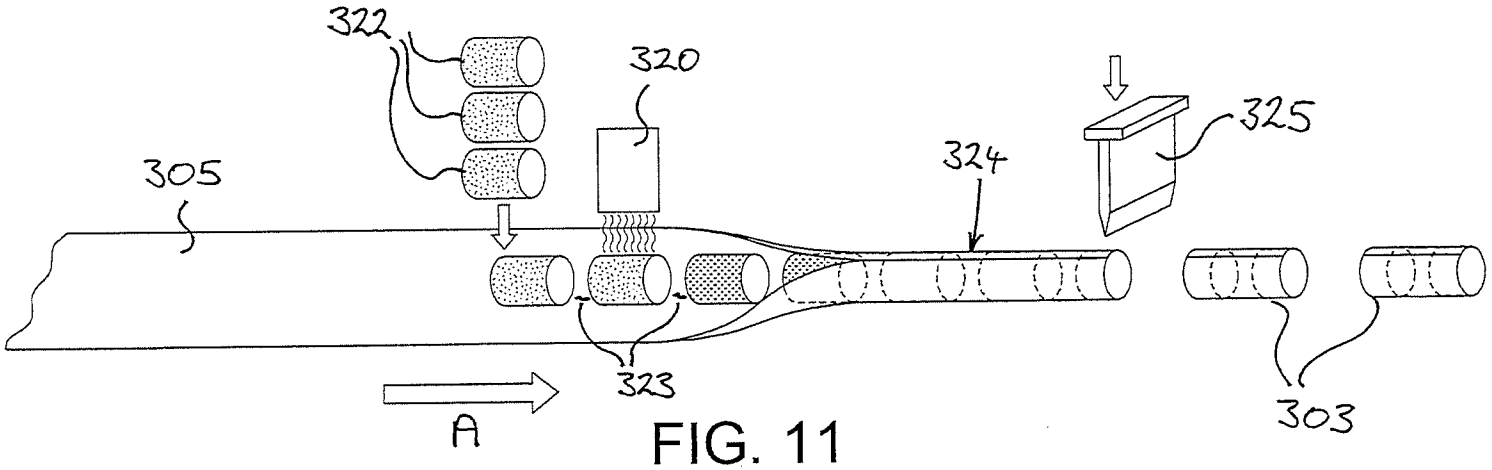
FIG. 11 is a schematic view of a further alternative manufacturing process of the invention for producing a filter as shown with the smoking article of FIG. 9.

A further alternative manufacturing process of the invention for producing the filter segments 304*a*, 304*b* of FIG. 9 is shown schematically in FIG. 11. As with the conventional manufacturing process described above and shown in FIG. 3, the outer plug wrap 305 is conveyed in the direction of arrow 'A' as a continuous strip from a reel or other such supply (not shown). Individual double-length filter segments 322, produced as described above and shown in FIG. 10, are placed onto the outer plug wrap 305 leaving a gap 323 therebetween. An anchorage adhesive activating means 320 is located downstream of the point at which the double length filter plug segments 322 are placed onto the outer plug wrap 305, which activates the dry anchorage adhesive 307 on the double-length filter segments 322. Various types of activatable adhesive 307 and adhesive activating means 320 may be employed within the scope of the invention. For example, the adhesive 307 may be heat activated and the activating means 320 may be a heater which may heat the double-length filter segments 322 using heating elements or infra-red radiation to activate the adhesive 307.

Downstream of the adhesive activating means 320, the outer plug wrap 305 is brought around the double length filter segments 322 with their activated adhesive 307 thereon and the outer plug wrap 305 is secured in place along a lap seam in an appropriate manner (not shown) to form a continuous filter rod 324. Finally, a cutter 325 cuts the continuous filter rod 324 at the mid-point of each double length filter segment 322 to form individual filters 303, each with the pair of filter segments 304*a*, 304*b* spaced from each other by a cavity 304*c* and secured within the tube of transparent outer plug wrap 305 by the anchorage adhesive 307 on the outer surface of each filter segment 304*a*, 304*b*.

Although in the further alternative process of the invention described above and illustrated in FIG. 11, the cutter 325 cuts the continuous filter rod 324 at the mid-point of each double-length filter segment 322 to form individual filters 303, in an alternative manufacturing process of the invention, the cutter 325 may cut the continuous filter rod 324 at the mid-point of every fourth or every sixth double-length filter segment 322 (for example) to form intermediate filter rods of four or six filters joined together. These '4-up' or '6-up' (for example) filter rods are chosen and created in dependence on the specific machinery to be used in a subsequent smoking article manufacturing process, which may require such 4-up or 6-up size intermediate filter rods to be supplied thereto and which then process and further divide such intermediate filter rods to form individual smoking articles with single filters 303 attached thereto.

It will be appreciated that the above-described alternative filter manufacturing process of the invention ensures that there is no anchorage adhesive 307 on the outer plug wrap 305 in the cavity 304*c* between the two filter segments 304*a*, 304*b* and so there is no glue residue visible through the window of the resulting window filter 303. Therefore, the further alternative filter 303 of the invention does not suffer the drawbacks of the conventional window filter 13 described above.

It will be appreciated by those skilled in the art that various modifications to the above-described embodiments of the invention are feasible and are intended to be included within the scope of the claims. For example, in the process of manufacturing double-length filter segments 322 described above with reference to FIG. 10, the activatable adhesive may not necessarily need to be sprayed onto the entire outer surface of the inner plug wrap 327 but instead, may be sprayed as a strip or other pattern covering part of the surface of the inner plug wrap 327. The anchorage adhesive 307 may also be applied to the inner plug wrap 327 by alternative means, such as roller(s) or brush(es). Furthermore, adhesive may be applied to both sides of the inner plug wrap 327 to aid the inner plug wrap 327 adhering to the continuous rod of filter material 328 when being wrapped therearound.

The outer plug wraps 105, 205, 305 of the invention are described as being made of a transparent material such that the cavity within the filter 103, 203, 303 is visible through the outer plug wrap. The term 'transparent' used herein is intended to refer to any material which is fully or partially see-through. This is, for instance, regardless of colour, so that clear, tinted, or otherwise 'translucent' materials are deemed to be 'transparent'. The 'transparent' material of the outer plug-wraps 105, 205, 305 may include, but is not limited to, polypropylene, polyvinyl chloride (PVC), cellulose acetate film, polyethylene terephthalate (PET), polyethylene oxide (PEOX), polyethylene, cellophane, Natureflex™ or polyactic acid (PLA). In addition to the outer plug wrap being totally transparent and clear or coloured transparent ('translucent'), it may further include patterns, markings, logos or other graphics or indicia printed thereon.

In the various embodiments of the filter 103, 203, 303 of the invention shown and described, the cavity 104*c*, 204*c*, 304*c* between the respective filter segments 104*a*, 104*b*/204*a*, 204*b*/304*a*, 304*b* is empty—i.e. is an air-filled space. However, it is intended within the scope of the invention that these cavities may alternatively be filled with a smoke-modifying material, such as an adsorbent material such as activated charcoal/carbon or other known suitable material. Such embodiments would provide a different but still attractive aesthetic effect, with the additional benefit that the filler material may adsorb some further constituents of the smoke not captured by the filter segments. A specific filler material can be chosen in dependence upon which constituents of smoke are intended to be adsorbed, or a general adsorbent can be selected which is capable of adsorbing many different types of smoke constituents. Alternatively, a mixture of different adsorbents can be used. As a further alternative, the cavity may be filled with a flavour-containing material.

All embodiments of the filter 103, 203, 303 of the invention described above show the filter comprising two filter plug segments 104*a*, 104*b*/204*a*, 204*b*/304*a*, 304*b* spaced from each other to define a single cavity 104*c*, 204*c*, 304*c* within the filter 103, 203, 303, the cavity 104*c*, 204*c*, 304*c* either being empty or filled with a filler material. However, the invention is intended to also encompass filters which may comprise one filter segment or more than two filter segments spaced from each other. In the case of a single filter segment, the filter may, for instance, be arranged to have a window portion surrounding one or more recesses within the filter segment itself, a window portion aligned with the filter plug itself, and/or a window portion surrounding a recess at either the mouth-end or tobacco end of the filter. The present invention may therefore avoid the appearance of adhesive lines within one or more of those window portions. In the case of a filter with more than two filter segments spaced from each other, these may, for instance, create more than one cavity within the filter, which may all be empty, or one or more may have a filler material therein. The material in each cavity may be the same or may be different. In such embodiments, an additional outer tipping wrapper may be provided aligned with any intermediate filter segments.

The various embodiments of filters 103, 203, 303 described and shown, and claimed within the scope of the present invention, can be manufactured in appropriate dimensions to be suitable for use in conjunction with various size formats of smoking articles, such as those commonly referred to as 'slim', 'superslim', 'kingsize', as well as regular smoking articles.

Only the further alternative filter 303 of the invention is shown and described as having filter segments 304*a*, 304*b* which comprise a cylinder of filter material 326 circumscribed by an individual inner plug wrap 327, in addition to being contained within the transparent outer plug wrap 305. However, the filter segments 104*a*, 104*b*/204*a*, 204*b* of the filters 103, 203 of the first and second-described embodiments of the invention may also include an inner plug wrap circumscribed around a filter plug in addition to the respective transparent outer plug wrap 105, 205.

All embodiments of the smoking articles incorporating filters of the invention described above include an outer plug wrap circumscribing the filter segment(s) and a separate tipping wrapper which joins the filter to the tobacco rod. However, the scope of the invention is intended to include alternative embodiments in which no tipping wrapper is provided to join the filter to the tobacco rod and, instead, the transparent outer plug wrap circumscribes both the filter segment(s) and the end of the tobacco rod. The outer plug wrap may include discrete opaque sections to define one or more window portions in the filter between the opaque sections, which opaque sections may be printed or painted onto the outer plug wrap material.

All embodiments of the filters of the invention shown and described comprise a window filter having a plurality of filter segments. However, it is intended within the scope of the invention that the filter may include one single segment of filtration media which may include one or more indentations or depressions which, once wrapped with a wrapper such as an outer plug wrap, form a cavity in the filter. Alternatively, the single-filter segment may not extend to the distal end of the filter and may thereby define a recess in the filter end, the recess possibly being at the mouth end or tobacco rod end of the filter. Such recess may also be formed by one of a plurality of filter segments of the filter being spaced from the distal end of the filter.

Although various embodiments of the smoking article filter and manufacturing method of the present invention have been described above, the scope of the invention is not intended to be limited to these examples and any combination of non-mutually exclusive features described above is also intended to fall within the scope of the invention, defined by the claims hereafter.

The invention claimed is:

1. A smoking article comprising a rod of smokable material, a filter attached to one end of the rod of smokable material and a window formed in the filter, the filter comprising one or more segments of filtration media and a substantially transparent wrapper at least part of which forms at least part of the window, wherein an anchoring adhesive is provided to secure the one or more filter segments to the wrapper, said anchoring adhesive being disposed exclusively between the one or more filter segments and portions of the wrapper other than those forming at least part of the window, wherein the smoking article further comprises a tipping wrapper attaching the filter to the rod of smokable material, the tipping wrapper extending over only part of the length of the filter such that a portion of the filter remains exposed to define the window, wherein the tipping wrapper comprises a first tipping wrapper and the smoking article further comprises a second tipping wrapper circumscribed around the mouth-end of the filter and axially spaced from the first tipping wrapper so that said window is defined between the first and second tipping wrappers.

2. The smoking article according to claim 1, comprising two or more filter segments spaced from each other to define a recess or cavity wherein the filter, wherein the window between the first and second tipping wrappers is aligned with the cavity or recess in the filter.

3. A method of manufacturing a smoking article comprising locating one or more segments of filtration media on a substantially transparent wrapper; providing an anchoring adhesive to secure the one or more filter segments to the wrapper; circumscribing the wrapper around the one or more filter segments to form a filter; placing a rod of smokable material adjacent one end of the filter in axial alignment therewith and circumscribing a tipping wrapper over the rod and filter to attach them together, wherein the tipping wrapper only extends over part of the length of the filter such that a portion of the filter remains exposed to define a window, wherein said tipping wrapper is a first tipping wrapper and the method further comprises circumscribing a second tipping wrapper around the mouth-end of the filter and axially spaced from the first tipping wrapper so that said window is defined between the first and second tipping wrappers; and wherein providing the anchoring adhesive comprises providing anchoring adhesive exclusively between one or more filter segments and portions of the wrapper other than those corresponding to the window.

4. The method according to claim 3, wherein when the filter comprises two or more filter segments spaced from each other to define a recess or cavity within the filter, and the method comprises applying the first and second tipping wrappers such that the window therebetween is aligned with the recess or cavity in the filter.

5. The method according to claim 3 wherein providing the anchoring adhesive comprises providing anchoring adhesive directly to the wrapper.

6. The method according to claim 5 further comprising conveying the wrapper as a continuous wrapper strip past an anchoring adhesive applicator and intermittently applying the anchoring adhesive onto the wrapper strip in discrete locations as it passes the anchoring adhesive applicator.

7. The method according to claim 6 further comprising placing filter segments onto the wrapper strip at a location downstream of the anchoring adhesive applicator in register with the conveyance speed of, and anchoring adhesive location on, the wrapper strip such that the filter segments are placed entirely over the discrete locations of anchoring adhesive.

8. The method according to claim 3 wherein providing the anchoring adhesive comprises applying anchoring adhesive directly to each filter segment while in place on the wrapper.

9. The method according to claim 8 comprising conveying the wrapper as a continuous wrapper strip, placing filter segments onto the wrapper strip at discrete locations and, applying the anchoring adhesive from an applicator in register with the conveyance speed of, and specific filter segment location on, the wrapper strip such that the anchoring adhesive is only applied to the filter segments.

10. The method according to claim 3 wherein providing the anchoring adhesive comprises applying anchoring adhesive directly to each filter segment prior to placement of each filter segment on the wrapper.

11. The method according to claim 10 wherein the anchoring adhesive is an activatable adhesive, the method further comprising conveying the wrapper as a continuous wrapper strip, placing filter segments with the activatable anchoring adhesive thereon onto the wrapper strip at discrete locations and, using an adhesive activating means to activate the adhesive on the filter segments.

12. The method according to claim 11 wherein the anchoring adhesive is a heat-activated adhesive and the adhesive activating means is a heating means.

13. The method according to claim 3, further comprising wrapping a wrapper strip around a line of filter segments thereon to form a continuous rod of filters and cutting the continuous rod at regular intervals.

14. The method according to claim 3, wherein locating one or more segments of filtration media comprises locating the plurality of segments of filtration media in axial alignment on the substantially transparent wrapper and spaced from one another to define one or more gaps therebetween and wherein circumscribing the wrapper comprises circumscribing the wrapper around the filter segments to define a cavity between the filter segments.

15. The method according to claim 14 wherein the window corresponds to the cavity in the filter.

* * * * *